United States Patent [19]

Lee

[11] Patent Number: 4,474,088

[45] Date of Patent: Oct. 2, 1984

[54] REVERSE PIN FOR SUCKER ROD TONGS

[76] Inventor: Kenneth W. Lee, O.D.S., Inc., 201 W. Hilmont Rd., Odessa, Tex. 79762

[21] Appl. No.: 414,475

[22] Filed: Sep. 2, 1982

[51] Int. Cl.[3] ..... B25B 17/00

[52] U.S. Cl. ..... 81/57.18; 81/57.21

[58] Field of Search ..... 81/57.18, 57.2, 57.21, 81/63.2

[56] References Cited

U.S. PATENT DOCUMENTS

| | | | |
|---|---|---|---|
| 858,894 | 7/1907 | Moss | 81/63.2 |
| 3,086,413 | 4/1963 | Mason | 81/57.19 |
| 3,180,186 | 4/1965 | Catland | 81/57.18 |
| 3,875,826 | 4/1975 | Dreyfuss et al. | 81/57.18 |
| 4,273,010 | 6/1981 | Farr et al. | 81/57.2 |

*Primary Examiner*—James L. Jones, Jr.
*Attorney, Agent, or Firm*—Wendell Coffee

[57] ABSTRACT

Tongs are provided for screwing together or unscrewing sucker rods for deep oil wells. A slotted ring gear is placed into a slotted annular housing plate and driven by conventional means. Heads on cage plates are moved by cam on the internal surface of the slotted ring gear. Relative movement between the cage plates carrying the head and the ring gear is governed by the position of a reversible ratchet stop which includes a beveled pin. The beveled pin is mounted in a hole through one of the cage plates and works on a slot in the ring plate. When the bevel is faced in one direction, it permits rotation of the ring gear to the cage plates in that direction, but holds the ring gear and cage plates in the matched position rotation in the other direction. The matched position is when the cams are in a neutral or withdrawn position and when the slots are aligned. The tongs are set either for making up the sucker rod or breaking it apart depending upon whether the alignment pin is set with the bevel in one direction or the opposite direction.

2 Claims, 6 Drawing Figures

Fig. 5-R

REVERSE PIN FOR SUCKER ROD TONGS

BACKGROUND OF THE INVENTION

1. Field of the Invention

This invention relates to power tongs and more particularly to a device for rotation of elongated goods and a reversing pin therefor.

2. Description of the Prior Art

Before this patent application was filed, applicant caused a patentabiltiy search to be made in the U.S. Patent and Trademark Office. The following patents are reported:

MASON: U.S. Pat. No. 3,086,413
CATLAND: U.S. Pat. No. 3,261,241
KELLEY: U.S. Pat. No. 3,371,562,
DICKMANN: U.S. Pat. No. 3,540,326,
DICKMANN: U.S. Pat. No. 3,548,692,
WILMS: U.S. Pat. No. 3,706,243,
WILMS: U.S. Pat. No. 3,793,913,
BUFKIN: U.S. Pat. No. 3,847,040,
DREYFUSS ET AL: U.S. Pat. No. 3,875,826,
ECKEL: U.S. Pat. No. 4,084,453,
ECKEL: U.S. Pat. No. 4,089,240,
CARSTENSEN: U.S. Pat. No. 4,215,602,
ECKEL: U.S. Pat. No. 4,290,304.

MASON U.S. Pat. No. 3,086,413 and DREYFUSS ET AL U.S. Pat. No. 3,875,826 appear to show beveled pins. However, as applicant understands these devices, they are for different purposes than his invention.

Applicant does not consider the other patents particularly pertinent to this invention, but is bringing them to the attention of the Examiner because they were reported to the applicant by an experienced patent searcher. Therefore, the applicant believes they would be of interest to the Examiner.

Power tongs for wells and more particularly oil wells are well-known and take different forms. Basically, the tongs include an annular housing plate. A torque arm is attached to the housing so that torque may be applied to the goods to be rotated. The goods may be either a casing, which has a relatively large diameter (7 or 8 inches), drill pipe, production or education tubing, or sucker rods.

A ring gear is mounted within the housing plate for rotation. The outside periphery of the ring has teeth driven either by a series of rotating gears or by a chain. A cage plate is coaxial with the ring gear and also with the annular housing plate. The cage plate may rotate relative to each. At least two heads are moveably mounted on the cage plates. These heads include jaws or teeth which engage the goods. The jaws are next to the axis of rotation. A cam follower is on the distal end of each head. The follower engages a cam on the inner face of the ring gear. The cam follower is often in the form of a roller. The cams on the inner face of the ring gear have neutral positions. This is where the heads are fully withdrawn from the goods so that the goods are released from the tongs.

Most power tongs have a means to open the housing plate, ring gear, and cage plates so that the tongs can be moved radially over the goods.

One particular type includes a slot in the annular housing plate, ring gear and cage plates. Therefore, if the slots in each of the elements were aligned, or matched, then the sucker rods or other goods can be moved through the slot to the axis of the power tongs.

Rotation in one direction will move the ring gear relative to the cage plates so that the cams push the heads for the goods to be rotated. Therefore, the ring gear must be free to rotate relative to the cage plates in the direction which the goods are to be rotated. However, to release the goods, the drive means for the ring gear is reversed so that the cam followers are brought back to the neutral or withdrawn position on the cams. This position occurs at the point the slots in the ring gears and cage plates will match. To prevent opposite rotation, it is necessary to lock or stop relative rotation of the ring gear to the cage plate at this matched position. The prior art accomplishes this by placing a pin through a hole in the cage plate that engages a lug upon the ring gear to stop relative rotation between these two elements in this position.

To change the sense or direction of rotation which the goods would be rotated, it was necessary to remove this pin and set it into another hole so that rotation would be allowed in the other direction, but would stop upon the reversal.

SUMMARY OF THE INVENTION (1) New and Different Function

I have invented power tongs particularly adapted to operate with sucker rods wherein the reversing of the tongs is simplified. Instead of having a pin that is moved from one hole to another, a single beveled pin is used. The bevel operates with a slot cut within the ring gear. The reversing pin, which is a form of a ratchet stop, may be reversed. I.e. it may be set in one position so that the bevel sets in one direction or it may be rotated 180°, or reversed, so that the bevel faces the opposite direction.

The direction in which the bevel faces will permit rotation of the ring gear against the bevel to raise the alignment pin against spring pressure so that the ring gear may rotate relative to the cage plate and force the heads into a set or locked position against the goods. Continued rotation of the ring gear will rotate the goods.

To disconnect the tongs from the goods, all that is necessary is to reverse the direction of the drive means. When the pin reaches the slot again, the pin will fall into the slot accoding to the spring pressure. The straight edge will strike the edge of the slot so there is no further relative rotation between the ring gear and the cage plate. This will be, as noted above, in the match position when the cam followers are within the withdrawn position on the cam and when the slots and the ring gear and the cage plate are matched.

To reverse the direction which the goods are being rotated, all that is necessary is to reverse the direction of the bevel on the alignment pin, which is accomplished by merely rotating the pin 180°.

Thus it may be seen that the function of my total combination, far exceeds the sum of the functions of the individual elements such as chains, gears, cams, bevels, etc.

(2) Objects of this Invention

An object of this invention is to rotate elongated goods such as sucker rods for an oil well.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

The specific nature of the invention, as well as other objects, uses, and advantages thereof, will clearly appear from the following description and from the accompanying drawing, the different views of which are not scale drawings. The drawings are simplified inasmuch as the purpose of the drawings is to illustrate the invention rather than to provide detailed shop drawings.

BRIEF DESCRIPTION OF THE DRAWING

FIG. 5-R is a plan view of the top of the alignment pin.

DESCRIPTION OF THE PREFERRED EMBODIMENT

Figure 1:
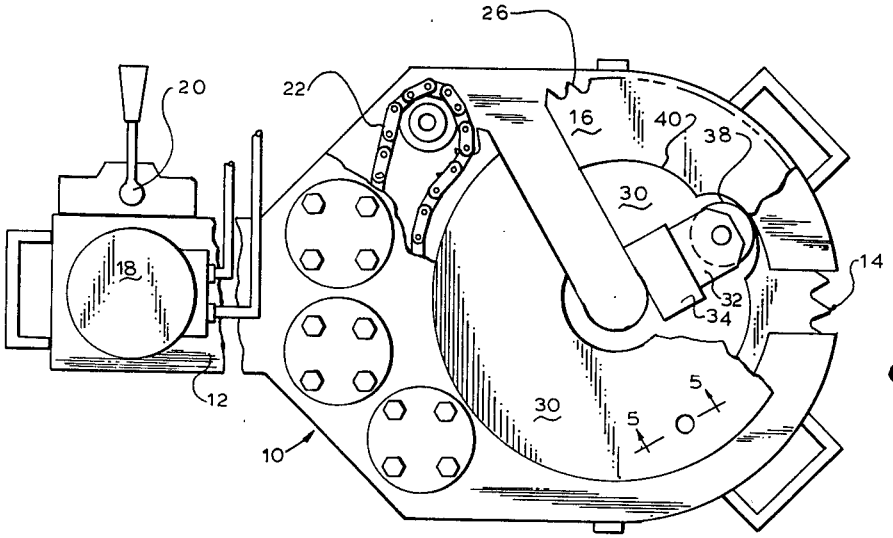
FIG. 1 is a plan view of a set of tongs according to my invention with parts broken away to show the operation.
Figure 2:
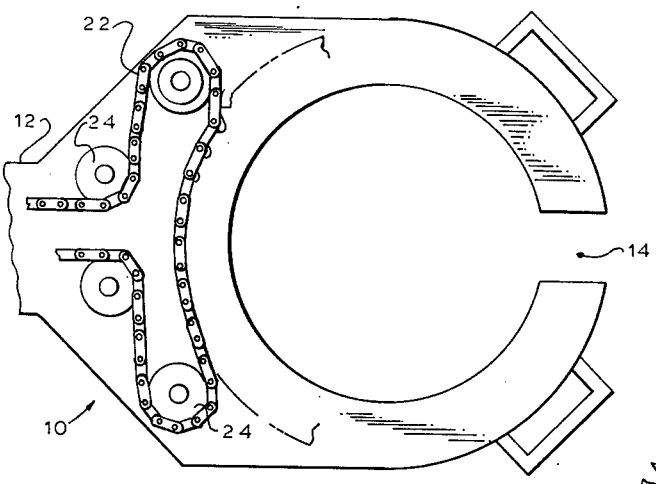
FIG. 2 is a partial plan view of the housing plate with the torque arm removed for clarity.
Figure 4:
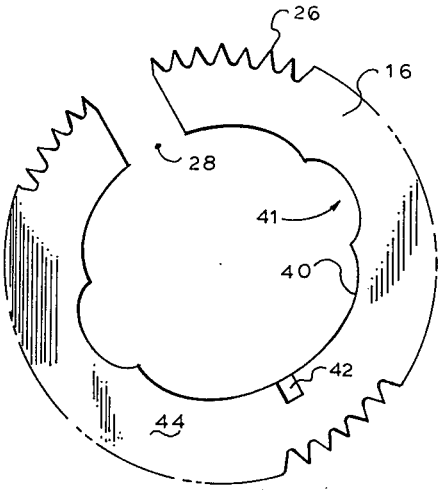
FIG. 4 is a plan view with parts broken away of the inside of one of the cage plates.
Figure 3:
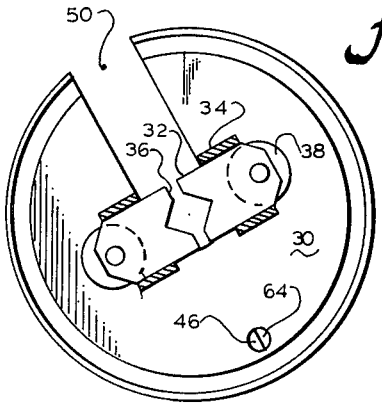
FIG. 3 is a plan view of the ring gear.

Referring to FIG. 1, there may be seen a power tong having annular housing plate 10. An integral part of the housing plate will be torque arm 12. Housing plate 10 is annular and has slot 14 opposite the torque arm 12 as discussed above. It will be understood that the housing plate 10, itself, includes housing necessary to retain the ring gear 16. However, for the purposes of clarity and conciseness, these have not been shown inasmuch as they are well-known to those having ordinary skill in the art. Hydraulic motor 18 is mounted upon the torque arm 12. It is a reversing motor so that it can be readily reversed by control valve 20. Through suitable gearing and other mechanism, the hydraulic motor 18 drives chain 22, which is trained around fixed sprockets 24. It may be seen the chain 22 will always be in contact with the teeth 26 upon the ring gear 16 regardless of the orientation. The ring gear 16 has slot 28 therein, but because of the nature of the chain, the chain will always drive the ring gear 16 regardless of the position of the slot 28. Thus a drive means including motor 18, chain 22, sprockets 24 etc. is provided.

Each cage plate 30 overlays the housing plate 10 and the ring gear 16 so it is coaxial with both the annular housing plate 10 and the ring gear 16. Cage plates 30 attach on each side and they are attached together so as to prevent axial movement of the cage plates 30 relative to the housing and ring gear 16. The slotted cage plates are thus rotatably mounted on the housing plate, coaxially therewith. Heads 32 are mounted within housings 34 for radial movement. The heads 32 have jaws 36 on the inside of them and cam followers in the form of rollers 38 on the outside. The cam followers or rollers 38 fit within cams 40 upon the ring gear 16. Thus it may be seen that cam surfaces 40 upon the ring gear 16 are form means for actuating the heads 32 into work gripping position responsive to movement of the ring gear 16 away from the neutral position with the cage plates 30.

Those having ordinary skill in the art will understand that the elements, and their combination, which have been described in detail to this point are all old and well-known before this invention. Also those having ordinary skill in the art, will understand that the explanation to this point is somewhat simplified and not all parts, or elements, or relationships have been described in detail inasmuch as those having ordinary skill in the art will understand how to make power tongs as has been described to this point.

Alignment slot 42 is cut in the radial face 44 of ring gear 16. For purposes of manufacture, I prefer to have the alignment slot 42 diametrically opposite the ring gear slot 28 and 90° from the withdrawn position or neutral position 41 of cams 40.

Beveled alignment pin 46 is slidably mounted through hole 48 in the cage plate 30. Likewise for purposes of manufacture, the hole 48 is diametrically opposite the slot 50 in the cage plate and rotated or displaced 90° from the center line of the heads 32 and the housing 34. Therefore, when the beveled alignment pin 46 is within the alignment slot 42 the cage plates and ring gear, will be in the match position, which is to say the slot 50 will be aligned or matched with the slot 28 of the ring gear. Also, in this matched position, the rollers 38 will be when the withdrawn portion or neutral position 41 of the cams 40, i.e. the jaws 36 will be fully withdrawn, and released from the work.

Figure 5:
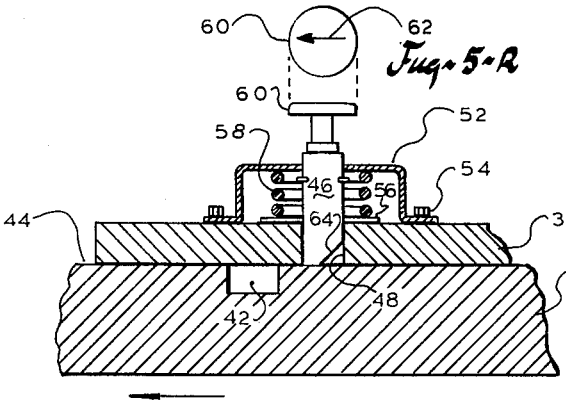
FIG. 5 is a sectional view taken substantially on line 5—5 of FIG. 1.
Figure 6:
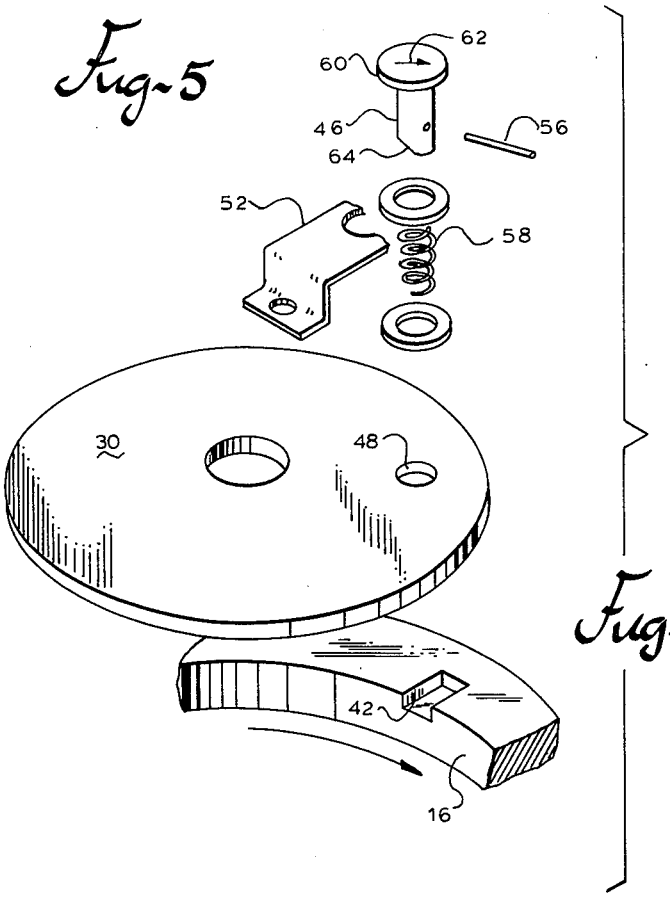
FIG. 6 is an exploded view of the elements shown in FIG. 5.

The beveled alignment pin 46 is mounted as shown in FIG. 5. I.e. a strap 52 is attached by bolts 54 to the top of the cage plate 30. Roll pin 56 extends diametrically through the beveled alignment pin 46. Helical compression spring 58 extends from the strap 52 to the roll pin 56 as shown in FIG. 5 to bias the beveled alignment pin 46 downward, or toward the ring gear 16 and more particularly toward the alignment slot 42.

The beveled alignment pin 46 has an indice 62 upon the button 60 to indicate which way rotation will occur. I.e. referring to FIG. 5-R, it may be seen that the indice 62 from the head upon the button 60 will indicate rotation to the left which would be the rotating direction of rotation of the ring gear 16 as indicated by an arrow thereon in the drawing. This, of course, is because bevel 64 upon the lower portion of the beveled alignment pin 46 is faced to the right. Therefore, when the ring gear 16 rotates to the left, the bevel 64 will permit the alignment pin 46 to move upward and out of the alignment slot 42.

Analysis will readily show that if it is desirable that the goods should rotate in the direciton opposite to that shown in the arrows in FIG. 5, the alignment pin can be rotated 180°. Therefore the bevel 64 will move out of the alignment slot 42 upon opposite direction of rotation. Thus it may be seen that I have provided a reversible ratchet stop means interconnecting the ring gear 16 and the cage plates 30 for releasing the ring gear 16 for rotation in one direction relative to the cage plate. This ratchet stop being the cooperation of the bevel 64 upon the bevel alignment pin 46 which releases when it rises from the slot 42. Also, it will be seen that when the rotation of the ring gear 16 is reversed by reversing control valve 20 that there is a ratchet means for stopping the cage plate and ring gear in the matched position. This means for stopping including the unbeveled portion of the alignment pin 46 dropping into the alignment slot 42.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

10 housing plate
12 torque arm
14 slot, housing
16 ring gear
18 hydraulic motor
20 control valve
22 chain
24 fixed sprockets
26 teeth
28 slot, ring gear
30 cage plate
32 heads
34 housings
36 jaws
38 rollers
40 cams
41 neutral position
42 alignment slot
44 radial face
46 beveled alignment pin
48 hole
50 slot, cage plate
52 strap
54 bolts
56 roll pin
58 helical compression spring
60 button
62 indice
64 bevel

I claim as my invention:

1. A power tong having a. a slotted annular housing plate, b. a torque arm extending rigidly radially from the housing plate, c. a slotted ring gear rotatably mounted in the housing plate co-axially therewith, d. drive means on the housing plate for rotating the ring gear, e. slotted cage plates rotatably mounted on the housing plate, co-axially therewith, f. the ring gear and cage plates having a matched position with the slots in each are aligned, g. heads moveably mounted on the cage plates for gripping the work, and h. a cam surface on the ring gear for activating the heads into work gripping position responsive to movement of the ring gear away from the matched position with the cage plates;

wherein the improvement comprises:

i. reversible ratchet means interconnecting the ring gear and cage plates for releasing the ring gear for rotation in one direction relative to the cage plate and for stopping the cage plate and ring gear in the matched position responsive to rotation of the ring gear in the opposite direction, j. a beveled, alignment pin extending through k. a hole in one cage plate, and l. a slot cut in a radial face of said ring gear, and m. spring means for pressing the pin toward the ring gear.

2. The invention as defined in claim 1 including all of the limitations a. through m. with the addition of the following limitations:

n. a diametrical pin extending through said alignment pin so that the alignment pin can have either of two positions, one position permitting rotation in one direction, and the other position permitting rotation in the opposite direction.

* * * * *